US007922436B2

(12) United States Patent
Mueller

(10) Patent No.: US 7,922,436 B2
(45) Date of Patent: Apr. 12, 2011

(54) APPARATUS FOR APPLYING ADHESIVE TO THE OUTSIDE SURFACES OF A BOOK BLOCK TO BE ENCASED IN A BOOK CASING INSIDE A CASING-IN MACHINE

(75) Inventor: Hans Mueller, Lauda-Koenigshofen (DE)

(73) Assignee: Mueller Martini Holding AG, Hergiswil (CH)

( * ) Notice: Subject to any disclaimer, the term of this patent is extended or adjusted under 35 U.S.C. 154(b) by 657 days.

(21) Appl. No.: 11/586,005

(22) Filed: Oct. 25, 2006

(65) Prior Publication Data

US 2007/0092356 A1 Apr. 26, 2007

(30) Foreign Application Priority Data

Oct. 25, 2005 (EP) ..... 05405603

(51) Int. Cl.

| | |
|---|---|
| ***B42C 11/00*** | (2006.01) |
| ***B42C 11/02*** | (2006.01) |
| ***B42C 11/04*** | (2006.01) |
| ***B42C 9/00*** | (2006.01) |

(52) U.S. Cl. ..... 412/37; 412/4; 412/5; 412/19; 412/21

(58) Field of Classification Search ..... 412/3–5, 412/8, 19, 21, 37; 173/216
See application file for complete search history.

(56) References Cited

U.S. PATENT DOCUMENTS

| | | | | |
|---|---|---|---|---|
| 1,870,700 | A * | 8/1932 | Von Webern et al. | 101/154 |
| 2,549,890 | A * | 4/1951 | Burls | 412/21 |
| 4,732,521 | A | 3/1988 | Kolkhorst | |
| 6,186,721 | B1 | 2/2001 | Ganter | |
| 6,352,252 | B1 * | 3/2002 | Schmucker et al. | 270/58.07 |
| 6,450,749 | B1 * | 9/2002 | Ganter | 412/37 |
| 2004/0239026 | A1 | 12/2004 | Nagai | |

FOREIGN PATENT DOCUMENTS

DE 15 36 505 A 2/1970

(Continued)

OTHER PUBLICATIONS

Derwent Abstract, JP 51104464.*

(Continued)

*Primary Examiner* — Dana Ross
*Assistant Examiner* — Kyle Grabowski
(74) *Attorney, Agent, or Firm* — Venable LLP; Robert Kinberg; Leigh D. Thelen

(57) ABSTRACT

An apparatus for the application of adhesive to the outside surfaces of book blocks to be encased in a casing inside a casing-in machine, includes an adhesive application device having two application rollers arranged opposite each other in an adhesive application area and which roll off respectively one outside surface of a book block that is conveyed while positioned on a saddle plate of a circulating conveyor. Each roller includes a recess that forms a shoulder parallel to the rotational axis, for applying adhesive to the fold region of a book block. The rotational position of the recess can be adjusted based on the position of a specific fold on a book block by providing the conveyor and the rollers with separate drives. The drives are controllably connected by a control unit. At least the drive for the application rollers of the adhesive application device comprises a controllable drive element.

16 Claims, 4 Drawing Sheets

FOREIGN PATENT DOCUMENTS

| | | | | |
|---|---|---|---|---|
| DE | 15 36 505 | A | | 2/1970 |
| DE | 20 12 356 | A | | 10/1971 |
| DE | 75 03 902 | U | | 6/1975 |
| DE | 37 13 896 | A | | 10/1987 |
| DE | 88 16 033 | U | | 2/1989 |
| DE | 199 55 993 | A | | 5/2001 |
| DE | 101 10 319 | A | | 9/2002 |
| EP | 0 198 201 | A | | 10/1986 |
| EP | 1 072 435 | A | | 1/2001 |
| EP | 1 072 436 | A | | 1/2001 |
| GB | 164 167 | A | | 6/1921 |
| GB | 776 439 | A | | 6/1957 |
| JP | 51104464 | | * | 9/1976 |

OTHER PUBLICATIONS

European Search Report with English translation dated Jan. 6, 2006, issued in EP 05 405603.1.

European Search Report dated Apr. 12, 2006, issued in European Application No. 05 40 5604 and its English-language translation.

Office Action dated Jul. 7, 2009, issued in related U.S. Appl. No. 11/585,989.

D. Liebau et al., "Industrielle Buchbinder," Industrial Bookbinders, Publishing House Verlag Beruf + Schule, Itzehoe, Germany, pp. 335-337.

European Search Report with English translation dated Jan. 6, 2006, issued in EP 05 405603.1.

* cited by examiner

APPARATUS FOR APPLYING ADHESIVE TO THE OUTSIDE SURFACES OF A BOOK BLOCK TO BE ENCASED IN A BOOK CASING INSIDE A CASING-IN MACHINE

CROSS-REFERENCE TO RELATED APPLICATION

This application claims the priority of European Patent Application No. 05405603.1, filed on Oct. 25, 2005, the subject matter of which is incorporated herein by reference.

BACKGROUND

The invention relates to an apparatus for applying adhesive to the outside surfaces of book blocks to be encased in book casings inside a casing-in machine. Such an apparatus includes an adhesive application device with two application rollers which are positioned opposite each other in the adhesive-application area, wherein each roller rolls off one outside surface of a book block that is conveyed on a saddle plate of a circulating conveyor. The adhesive application rollers are provided with a recess that forms a shoulder parallel to the rotational axis and is used to apply adhesive to the fold region of a book block. The rotational position of the recess can be adjusted and changed based on the position of a specific fold on a book block conveyed through the adhesive-application area. The speed of the conveyor for the saddle plates and the rotational movement of the application rollers, which cooperate with the latter, are synchronized.

Until the present, a considerable expenditure in equipment was necessary in a casing-in machine for adjusting the adhesive-application rollers relative to the book block. According to European patent document EP 1 072 435 A1, a traction mechanism is provided for an infinitely variable adjustment of the relative position between saddle plate and/or conveyor and the rotational position of the application rollers. Among other things, this type of arrangement has the disadvantage that adhesive can be applied only according to a fixed pattern since the position of the conveyor relative to the adhesive application device cannot be changed.

The present invention takes a different approach by providing an apparatus of the aforementioned type with structural measures for optimizing the orientation of the adhesive-application rollers, relative to the book block that is passing through, thereby resulting in a better quality and higher reliability. Product-dependent variables must be taken into consideration for this, for example, the book block thickness, the shape of the book block spine, and/or the paper quality.

SUMMARY

The above and other objects are accomplished according to the invention by the provision of an apparatus for applying adhesive to outside surfaces of book blocks to be encased in casings inside a casing-in machine, each book block including a fold region, wherein in one embodiment of the invention, the apparatus includes: a circulating conveyor including saddle plates on which a respective one of the book blocks is to be conveyed; an adhesive application device including two application rollers arranged opposite each other in an adhesive-application region, thereby allowing each roller to roll off one outside surface of a book block that is conveyed on a saddle plate, the rollers having parallel rotational axes, each roller including a recess that presents a shoulder parallel to the rotational axis of the roller and adapted to apply adhesive to the fold region of a book block, wherein the rollers are mounted so that a rotational position of each roller is adjustable and changeable based on a position of a specific fold of the book block that passes through the adhesive application region, and wherein the conveyor has a movement that is synchronized with the rotational movement of the application rollers; separate drives coupled to the application rollers and the circulating conveyor for an infinitely variable change in the relative position between the saddle plates on the conveyor and the rotational position of the application rollers; and a joint control unit connected to and controlling the separate drives, wherein at least the drive for the application rollers of the adhesive application device comprises a controllable drive element.

Among other things, the invention, renders it unnecessary to have an auxiliary drive, which would require considerable structural expenditure for maintaining the liquid state of the adhesive in case of a production interruption.

An embodiment of the foregoing type also advantageously affects the slippage adjusted between an application roller and a saddle plate, which leads to a uniform coating with adhesive and can also affect the book shape, wherein the slippage can be adjusted or changed easily during the production.

As previously mentioned, several drive components can furthermore be omitted as a result of the invention because the drive for the apparatus according to the present invention is mechanically uncoupled and can be added only by activating it with the aid of a central drive.

BRIEF DESCRIPTION OF THE DRAWINGS

These and other features and advantages of the invention will be further understood from the following detailed description of embodiments of the invention with reference to the accompanying drawings.

DETAILED DESCRIPTION

Figure 1:
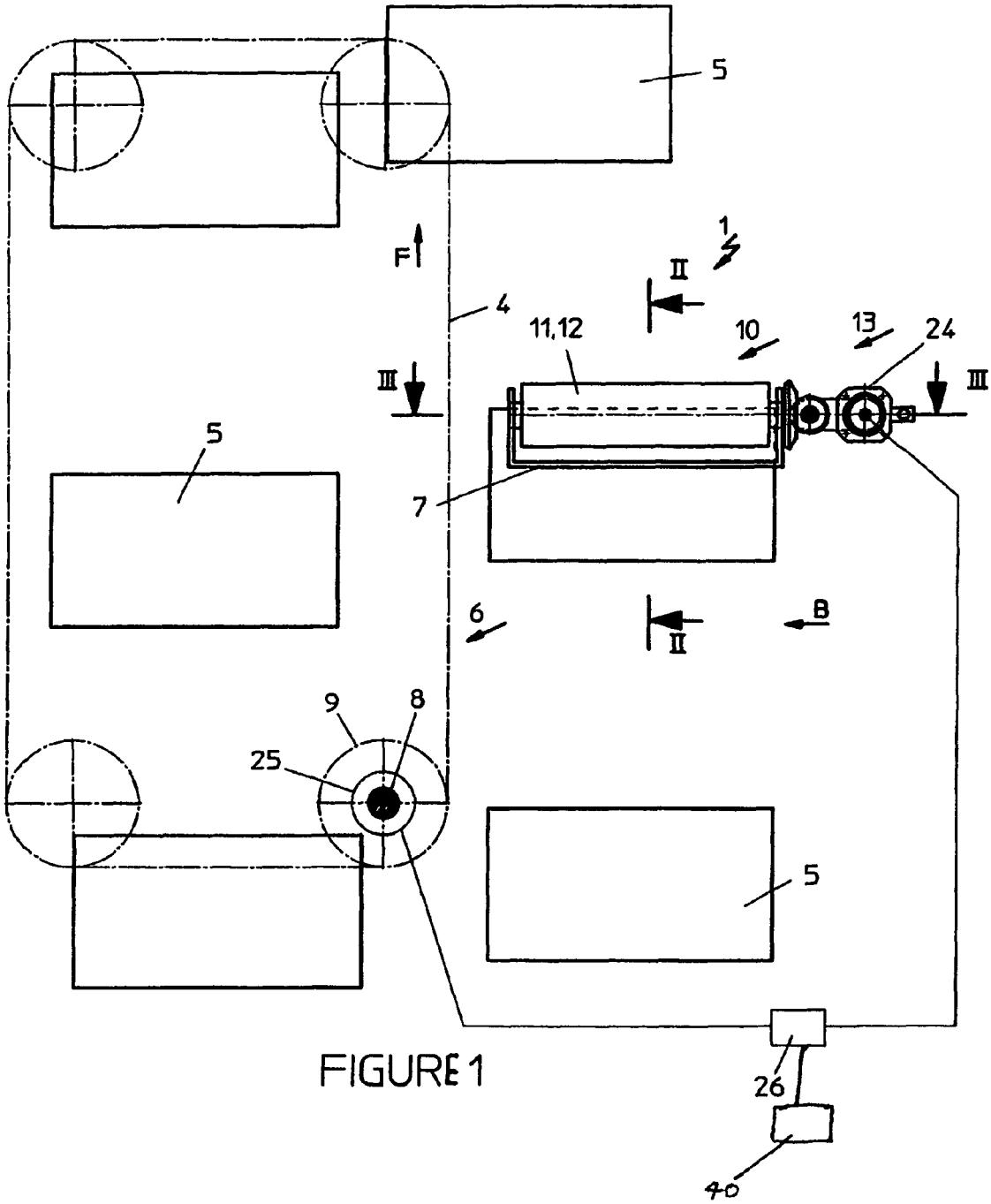
FIG. 1 is a schematic representation of an apparatus for applying adhesive to a book block.
Figure 2:
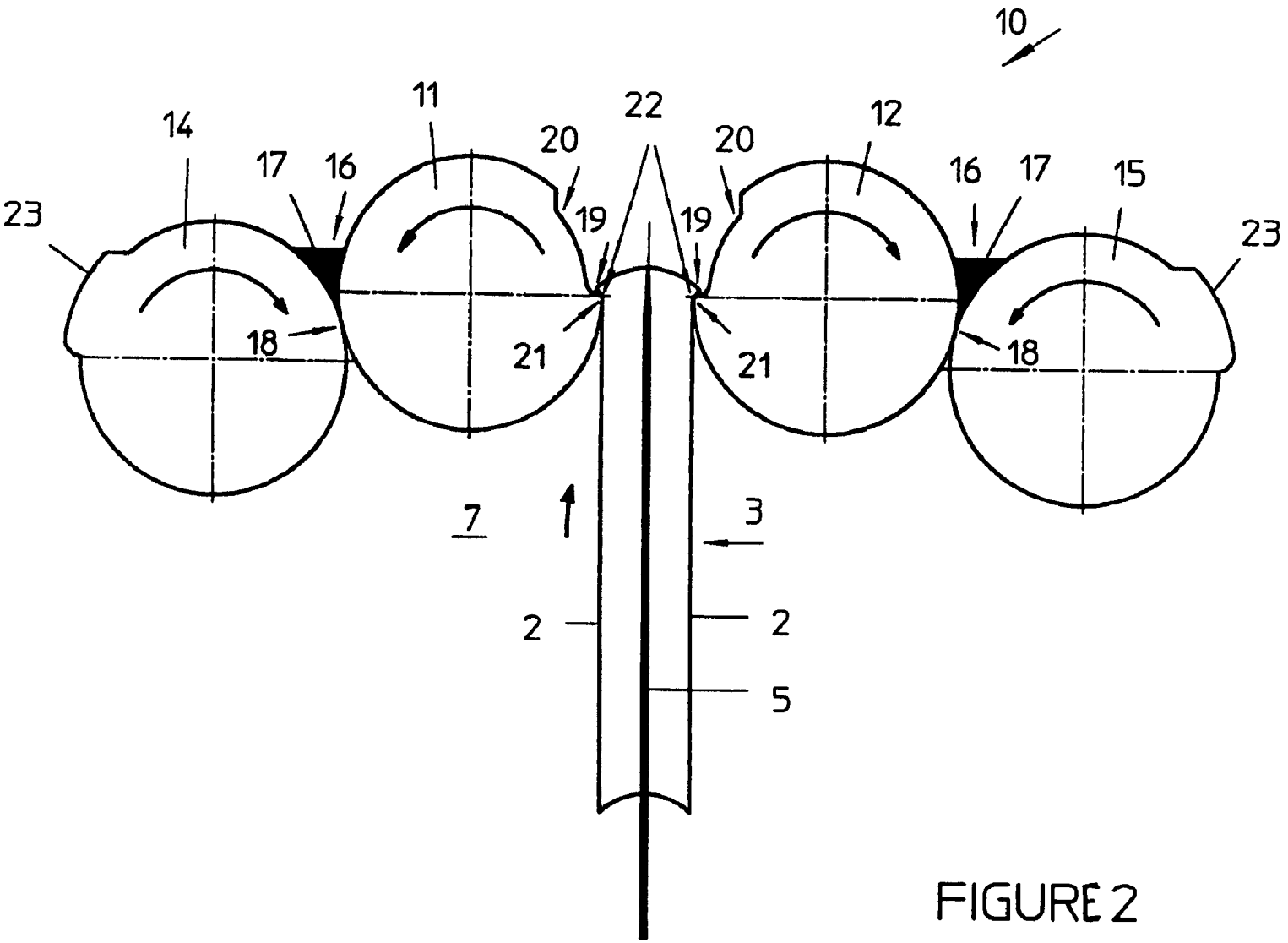
FIG. 2 is a cross section through an adhesive application device on a book block casing-in machine.

FIG. 1 illustrates an apparatus 1 of a book block casing-in machine, used for applying adhesive to the outside surfaces 2 of a book block 3 shown in FIG. 2. The arrow F in FIG. 1 indicates the direction of movement of several saddle plates 5 that are mounted on a circulating conveying element 4, such as a chain, which jointly form a bucket-type conveyor 6. FIG. 1 furthermore shows the constant positioning of the saddle plates 5 on the movement path, where they have an at least approximately horizontal upper edge.

The conveyor 6 is driven, for example, by a sprocket wheel 9 that is attached to a drive shaft 8. According to FIG. 2, the book blocks 3 are positioned with the open front pointing downward over a saddle plate 5 that performs the function of a block divider which spreads apart the book blocks in the center. The book blocks are moved to a position on the conveyor 6 where the saddle plates 5 take over the book blocks 3 by being inserted from below into the slightly spread-apart book blocks. Following this, the book blocks 3, which are positioned straddling on the saddle plates 5, travel in a vertically upward direction through an adhesive application device 10. Subsequently, a book casing (not shown), which is supplied from one side, is pressed against the adhesive-covered outside surfaces 2 and/or the end papers of a book block 3. According to FIG. 1, a drive mechanism 13, described below, drives the adhesive application rollers 11, 12 that form the adhesive application device 10.

The illustrated embodiment of the adhesive application device 10 according to FIG. 2 essentially includes adhesive-application rollers 11, 12 with corresponding metering rollers 14 and 15, which are profiled along the circumference. Arrows indicate the rotational direction for the application rollers 11, 12 and the metering rollers 14, 15, as well as the movement direction for the book block 3 which is positioned straddling on a saddle plate 5. The application rollers 11, 12 and the metering rollers 14, 15 have a circular cylindrical surface along most of the circumference. The different roller axes are offset relative to each other and form a wedge 16 in the region of greatest convergence, to accommodate a metered amount of adhesive 17. The two rollers of each roller pair 11, 14 and 12, 15 move from the top toward the bottom through a roll-off zone 18, in which the metering rollers 14, 15 provide the surface of the application rollers 11, 12 with a specific amount of adhesive. The spacing between the rollers 11, 14 and 12, 15, can control the thickness of the adhesive application. In the process, the application rollers 11, 12 transfer the carried-along adhesive onto the outside surfaces 2 of a book block 3, which comes in contact with the application rollers 11, 12 while moving from the bottom toward the top in the area located approximately opposite the roll-off zone 18.

To ensure that the desired amount of adhesive is applied, in particular to the fold and/or in the fold region 19 of the book block 3, the application roller 11, 12 is provided with a recess 20 which is deep enough, so that a trailing shoulder 21 as seen in the rotational direction can accommodate the fold 22 on the book block 3. A projection 23 which complements the recess 20 is correspondingly formed onto the metering roller 14, 15 and dips into the recess 20 during the rotation of rollers 11, 14 and 12, 15, provided these are located in the roll-off zone 18. The projection 23 here ensures that while passing through the roll-off zone 18, the amount 17 of adhesive in the roller wedge 16 is retained and the surface of the recess 20 is supplied with the required amount of adhesive to be applied to the fold 22. The recess 20 and the projection 23 extend parallel to the axes for the rollers 11, 14 and 12, 15, perpendicular to the drawing plane and with a uniform profile. This type of application roller 11, 12 and metering roller 14, 15 is known from prior art and is used to illustrate the mode of operation of an adhesive application device 10, as shown with the simplified embodiment in FIG. 1, which is mounted inside an adhesive trough 7.

The rounding of a book block spine influences the shape of the fold and is critical to maintaining the shape of a book back when the book is used. The rounding of a book block can be selected based on its thickness and leads to the creation of a specific fold during the so-called pressing on, wherein the fold is then coated with adhesive by a pair of application rollers. It is therefore of special importance that the application rollers be adapted optimally to different forms of the fold on the book blocks 3 to be encased. The rounding and pressing on is described among other things in further detail in the book "INDUSTRIELLE BUCHBINDER" [Industrial Bookbinders], Liebau/Heinze, Publishing House Beruf+Schule, in Itzehoe, GERMANY, as well as in other relevant literature.

Figure 3:
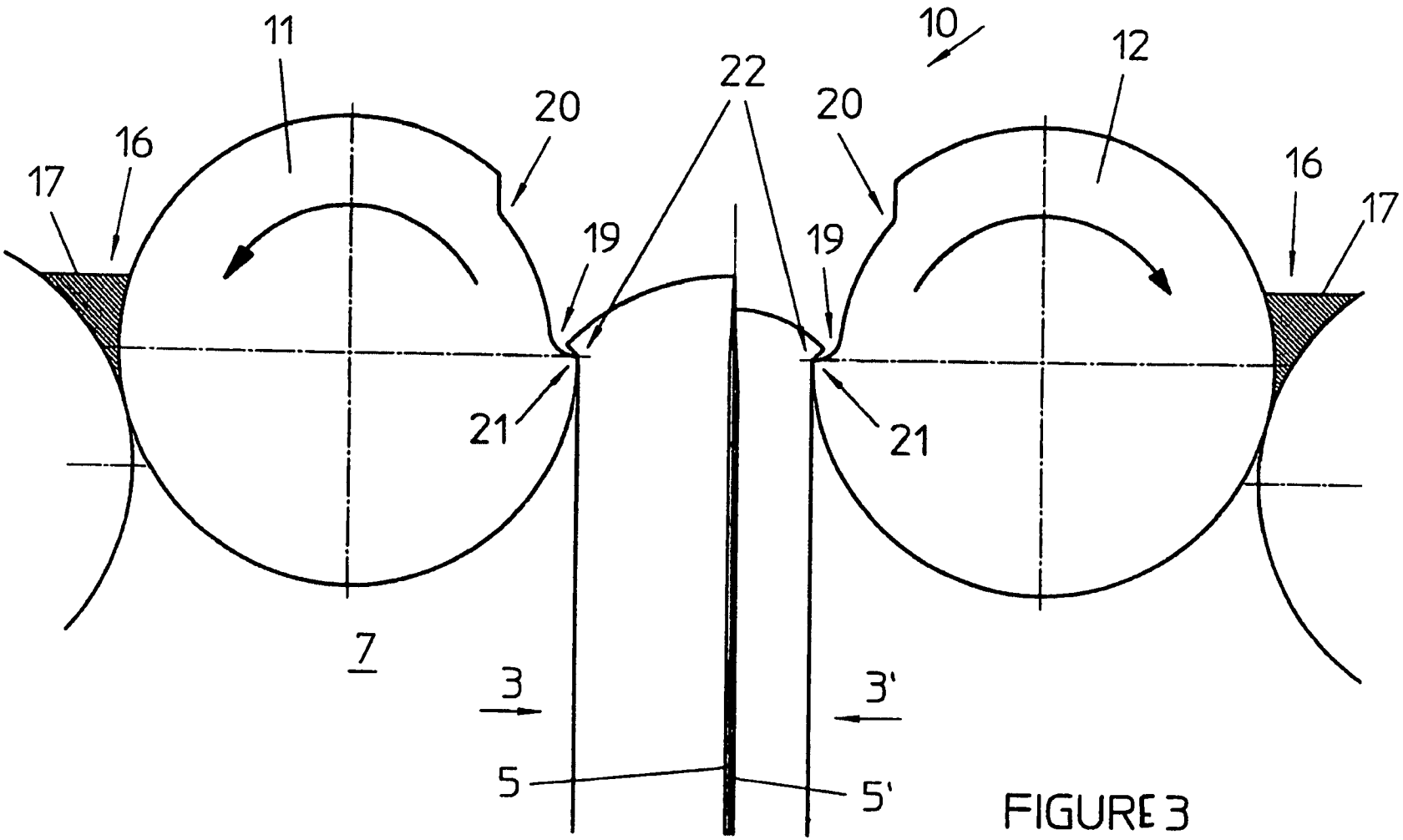
FIG. 3 is a detail from FIG. 2.

FIG. 3 illustrates an arrangement and a mode of operation of an adhesive application device 10 for book blocks 3, 3' of different thicknesses.

Figure 4:
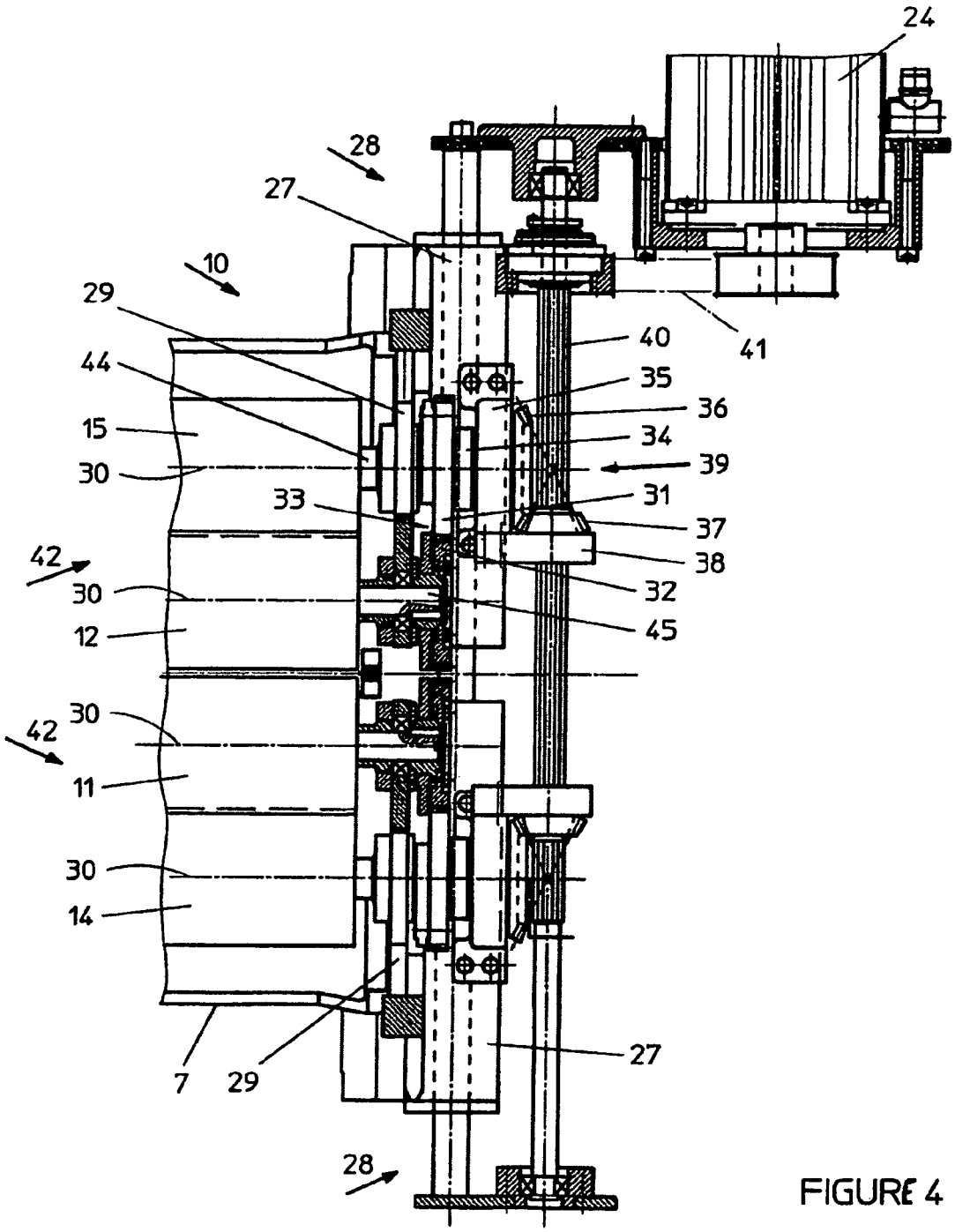
FIG. 4 is a driving gear for an adhesive application device.

FIGS. 1 and 4 show the drive for the apparatus 1. The conveyor 6 and the application rollers 11, 12 are driven by separate drive motors 24, 25 to ensure an infinitely variable adjustment or change of the relative position between the saddle plates 5 on the conveyor 6 and the rotational position of the application rollers 11, 12 on the adhesive application device 10. The separate drive motors are connected to and controlled by a joint control unit 26, which may be coupled to a computer 40, wherein at least the drive motor 24 for the application rollers 11, 12 on the adhesive application device 10 is embodied as a controllable drive element. The conveyor 6 generally circulates with a uniform speed, thus making it possible to adapt the relative position of the adhesive application device 10. As a result, the application rollers 11, 12 can be controlled and/or variably controlled on the basis of a contact point for the application rollers 11, 12, which corresponds the position of the fold 22 on a book block 3. It is thus possible to control and/or variably control the rotational movement of the application rollers 11, 12 for applying adhesive to a book block 3, based on an adhesive-application section that is determined by the book block 3 and/or a book casing or its book covers. For this, the position and/or rotational movement of the application rollers 11, 12 can be adjusted and changed manually. Furthermore, the rotational movement and/or the position of the application rollers 11, 12 can also be adjusted and changed program-controlled by a computer.

The rotational movement of the application rollers 11, 12 can also be controlled and/or variably controlled on the basis of a book block 3 that is conveyed on the conveyor 6.

The drive element and/or the drive motor 24 for the adhesive application device 10 may be an electric motor controlled by angle of rotation, and may in fact comprise a servomotor.

The electric motor can be a linear motor and can be driven program-controlled on the basis of a cam curve, which may be stored, for example, in computer 40, wherein the cam curve may be changeable.

FIG. 4 illustrates a drive for an adhesive application device 10, which is attached to a machine frame of a book block casing-in machine, such that it can be displaced along a guiding device for the removal. A carriage 27 is provided for this, which can be displaced in a guide arrangement 28 that is visible only on the drive side for the adhesive application device 10. The carriage 27 mounts the metering and application roller pairs 14, 11 and 12, 15. Owing to the different thicknesses of the book blocks 3 passing between the application rollers 11, 12, the distance between the application rollers 11, 12 of the roller pairs 11, 14 and 12, 15 can be variably adjusted. For that reason, the roller pairs 11, 14 and 12, 15 are positioned in a bearing plate 29 which can be displaced on the carriage 27, transverse to the rotational axes 30 of the rollers. The roller pairs 11, 14 and 12, 15 are respectively driven by a gear reducer unit 33 comprising two meshing gearwheels 31, 32. The drive shaft for the metering rollers 14, 15, which extends on the drive side through the bearing plate 29, is connected by a clutch 34 to a conical gear 36, positioned in a bearing block 35 that is attached to the carriage 27. An angular gear 39 is formed by the conical gear 36 together with a second conical gear 37, which is positioned at a right angle to the conical gear 36 in a support bracket 38 that is attached to the bearing block 35. The second conical gear 37 is positioned displaceably on a multi-spline shaft 40, which is coupled to the drive motor 24 and is arranged parallel to the direction of displacement for the carriage 37. The multi-spline shaft 40 is positioned in a frame connected to the machine frame and is connected to the drive motor 24 by a circulating traction device 41. Of course, a reducing gear could also be used in place of the traction device 41. One skilled in the art will select an optimum arrangement of drive motor 24 and gear on the basis of the available space conditions. A variable adjustment of the distance between the application rollers 11, 12 is possible in this way.

It will be understood that the above description of the present invention is susceptible to various modifications, changes and adaptations, and the same are intended to be comprehended within the meaning and range of equivalents of the appended claims.

What is claimed is:

1. An apparatus for applying adhesive to outside surfaces of book blocks to be encased in casings inside a casing-in machine, each book block including a fold region, the apparatus comprising:

a circulating conveyor including saddle plates on which a respective one of the book blocks is to be conveyed;

an adhesive application device including two application rollers arranged opposite each other in an adhesive-application region, thereby allowing each application roller to roll off one outside surface of a book block that is conveyed on a saddle plate, the application rollers having parallel rotational axes, each application roller including a recess that presents a shoulder parallel to the rotational axis of the roller and adapted to apply adhesive to the fold region of a book block, wherein the application rollers are mounted so that a rotational position of each application roller is adjustable and changeable based on a contact point that corresponds to a position of a specific fold of the book block that passes through the adhesive application region, and wherein the conveyor has a movement that is synchronized with the rotational movement of the application rollers;

separate drives coupled to the application rollers and the circulating conveyor for an infinitely variable change in the relative position between the saddle plates on the conveyor and the rotational position of the application rollers; and a joint control unit connected to and controlling the separate drives, wherein at least the drive for the application rollers comprises a controllable drive element.

2. The apparatus according to claim 1, wherein the rotational movement of the application rollers for applying adhesive to a book block is controlled as a function of an adhesive application section that is determined by the book block or a cover for the book casing.

3. The apparatus according to claim 1, wherein the rotational movement of the application rollers is manually adjustable.

4. The apparatus according to claim 1, wherein adhesive application device is adapted for being program-controlled by a computer to control the rotational movement of the application rollers.

5. The apparatus according to claim 1, wherein the rotational movement of the application rollers is controlled as function of the position of a book block that is conveyed on the conveyor.

6. The apparatus according to claim 1, wherein the drive element for the application rollers comprises an electric motor with rotational angle control.

7. The apparatus according to claim 6, wherein the electric motor comprises a linear motor.

8. The apparatus according to claim 1, wherein the drive element for the application rollers is adapted to be driven program-controlled on the basis of a cam curve.

9. The apparatus according to claim 8, wherein the cam curve is changeable.

10. The apparatus according to claim 1, wherein the adhesive application device comprises:

two roller pairs, each roller pair including one of the two application rollers and a metering roller, the application rollers and metering rollers each having a drive shaft, the drive shafts being parallel to one another; and a carriage mounting the two roller pairs and being moveable in a direction transverse to the rotational axes of the drive shafts of the rollers;

wherein the separate drive for the application rollers includes a drive motor mounted on the carriage and an angle gear including a conical wheel having a rotation axis arranged parallel to the displacement direction of the carriage and connected to the drive motor.

11. The apparatus according to claim 10, wherein the carriage includes a bearing block and the angle gear is positioned in the bearing.

12. The apparatus according to claim 10, further including gears to drive connect the application roller and the metering roller of each roller pair.

13. The apparatus according to claim 10, further including a bearing plate mounted on the carriage, wherein the roller pairs are positioned in the bearing plate.

14. The apparatus according to claim 10, wherein the angle gear is detachably coupled to at least one of the drives shafts of the application rollers or the metering rollers.

15. The apparatus according to claim 10, wherein the drive motor includes a drive shaft and the separate drive for the application rollers further includes a multi-spline shaft coupled to the drive shaft of the drive motor.

16. An apparatus for applying adhesive to outside surfaces of book blocks to be encased in casings inside a casing-in machine, each book block including a fold region, the apparatus comprising:

a circulating conveyor including saddle plates on which a respective one of the book blocks is to be conveyed;

an adhesive application device including two application rollers arranged opposite each other in an adhesive-application region, thereby allowing each application roller to roll off one outside surface of a book block that is conveyed on a saddle plate, the application rollers having parallel rotational axes, each application roller including a recess that presents a shoulder parallel to the rotational axis of the roller and adapted to apply adhesive to the fold region of a book block, wherein the application rollers are mounted so that a rotational position of each application roller is adjustable and changeable based on a position of a specific fold of the book block that passes through the adhesive application region, and wherein the conveyor has a movement that is synchronized with the rotational movement of the application rollers;

separate drives coupled to the application rollers and the circulating conveyor for an infinitely variable change in the relative position between the saddle plates on the conveyor and the rotational position of the application rollers;

a carriage mounting the two application rollers and being moveable in a direction transverse to the rotational axes of the drive shafts of the application rollers, wherein the separate drive for the application rollers includes a drive motor mounted on the carriage and an angle gear including a conical wheel having a rotation axis arranged parallel to the displacement direction of the carriage and connected to the drive motor; and a joint control unit connected to and controlling the separate drives, wherein at least the drive for the application rollers comprises a controllable drive element.

* * * * *